United States Patent [19]

Burkhart

[11] Patent Number: 4,575,069

[45] Date of Patent: Mar. 11, 1986

[54] SHEET FEEDING MECHANISM

[75] Inventor: Christopher W. Burkhart, San Jose, Calif.

[73] Assignee: Qume Corporation, San Jose, Calif.

[21] Appl. No.: 494,600

[22] Filed: May 13, 1983

[51] Int. Cl.[4] ..... B65H 29/18; B65H 31/00

[52] U.S. Cl. ..... 271/186; 271/207

[58] Field of Search ..... 271/182, 184, 185, 186, 271/65, 189, 207, DIG. 9, 314

[56] References Cited

U.S. PATENT DOCUMENTS

| | | | |
|---|---|---|---|
| 1,541,651 | 8/1923 | Matlack | 198/404 |
| 1,836,856 | 10/1929 | Lloyd | 271/186 |
| 1,991,511 | 2/1935 | Lyman et al. | 271/186 |
| 2,363,490 | 4/1942 | Avery | 101/132 |
| 2,528,420 | 10/1950 | Carroll et al. | 400/625 |
| 3,966,194 | 6/1976 | Abbe et al. | 271/186 |
| 4,027,580 | 6/1977 | Sundin | 414/43 |
| 4,189,135 | 2/1980 | Costa | 271/4 |
| 4,220,323 | 9/1980 | Smith | 271/65 |
| 4,300,757 | 11/1981 | Koiso et al. | 271/207 |
| 4,371,276 | 2/1983 | Mitrovich et al. | 400/625 |

FOREIGN PATENT DOCUMENTS

| | | | |
|---|---|---|---|
| 684837 | 4/1964 | Canada | 271/186 |

*Primary Examiner*—Bruce H. Stoner, Jr.
*Assistant Examiner*—James E. Burlow
*Attorney, Agent, or Firm*—T. L. Peterson; J. M. May

[57] ABSTRACT

A sheet handling path extending from an entrance location to an exit location is provided by a small diameter rotatable roller and several parallel transversely spaced flexible belts. At the exit location, several deflector arms mounted on an actuator shaft initially deflect the leading portion of an exiting sheet towards the forward wall of an underlying receiving tray. An exit roller may also be provided at the exit location. After the leading edge of a sheet has reached the forward wall and the sheet has started to form a buckle, the deflector arms are rotated to a remote position permitting the sheet to be translated rearwardly by friction between the overlying flexible belts and the sheet until a trailing edge of the sheet springs clear of the belts and settles under its own weight into the receiving tray. In accordance with one embodiment, the mechanism for rotating the deflector arms from the deflecting position to the remote position provides a compliant resistive force to the deflector arms so that the buckle will tend to displace the arms away from their active position and the sheet buckle will form without jamming or creasing regardless of the height of the stack in the tray. In accordance with another embodiment, the distance from the exit location to the front of the stack is essentially constant for various stack heights and the arms are rotated to their remote position as soon as the leading edge is in contact with the forward wall of the tray. A simple override mechanism enables the device to provide the document collation (inversion) function, or a direct exit feed function in which the deflector arms are maintained in the remote position.

10 Claims, 9 Drawing Figures

SHEET FEEDING MECHANISM

BACKGROUND OF THE INVENTION

This invention relates to sheet feeding mechanisms for use in conveying individual documents from a print station to a stacking station.

In many types of printing and copying systems individual documents are printed or otherwise reproduced (e.g. by electrostatic copying of an original) at a first station or location (hereinafter termed the printing station), and the individual documents thus produced are serially fed to a stacking station, such as a stacking bin, where the individual documents accumulate in a stack. In many applications, it is highly desirable that the stacking station be closely adjacent the printing station for the efficient collection and distribution of the finished documents. Many different arrangements have been employed to provide a closely adjacent stacking station, and such arrangements typically include a fixed or removable tray positioned above and to the rear of the printing station into which the individual documents are serially fed and stacked automatically.

In many applications, it is highly undesirable for the sheets to collect in reverse order, which is the normal stacking mode absent any additional sheet handling mechanisms. In order to provide collated or serially arranged copies in their proper order, many improvements have been proposed and employed on the basic stacking station noted above. Such improvements include completely passive devices generally employing a stationary deflector plate against which the leading edge of each document initially bears when arriving at the stacking station and which causes the leading edge of the document to be turned upside down and deflected downwardly into the stacking tray. Such devices normally use the weight of the paper to assist in the collection of the documents in the stacking tray, and an example of such an arrangement is illustrated in U.S. Pat. No. 4,300,757. Other sheet handling mechanisms employ active elements which grasp the leading edge of the sheet as it enters the stacking station and pull the sheet typically around a one hundred eighty degree circular path provided by a platen mechanism so that the document is positively drawn into the stacking station. An example of such an arrangement is illustrated in U.S. Pat. No. 4,027,580.

Since document sheets of widely varying weights are employed in the same printing/reproducing apparatus in many applications, many stacking station arrangements with the document collation feature tend to cause jamming or crinkling of the documents, particularly when the lighter weight sheets are employed (since their resistance to crinkling is quite low). This problem is exacerbated in the passive type deflector installations which rely on the stiffness of the paper and the contact with the leading edge of the document to the defined deflection of the sheet. While it is possible to minimize this disadvantage by providing a document feed path with more gradual contours, passive deflectors are nevertheless unacceptable in those applications which require a low height profile and the efficient use of space, which is particularly true in office environment applications.

Many active devices, while adequate when used in conjunction with standard weight sheet stock, have a tendency, particularly when non-standard sheet stock is used, to wrinkle the document or tear its leading edge.

While it is possible to ameliorate this problem by providing a relatively large platen having a large throat area and a large radius of curvature, this solution increases the height profile of the sheet handling mechanism, which is undesirable for low profile applications.

While the collation feature noted above is preferred in many sheet feeding applications, there are some documents for which this feature is not suited due to the requirement that the document be fed through a 180° path reversal. Printed envelopes, for example, have a tendency to skew when manipulated in an active sheet feeding device, which typically results in a jamming of the mechanism. Similarly, when passed through a passive deflector the envelopes tend to accumulate in the tray in a haphazard fashion and thick envelopes tend to jam near the entry point.

With passive devices, the only practical way to defeat the collation function is to remove the deflector, which requires that the upstream printing mechanism be deactivated and is thus undesirable. Although active devices can be provided with an override mechanism to defeat the collation function, this solution requires the addition of active elements, which increases the complexity and cost of the device and increases the likelihood of mechanical failure.

SUMMARY OF THE INVENTION

The invention comprises a sheet feeding mechanism affording both the collating function and a direct stacking function which is relatively inexpensive and uncomplicated, requires a minimum of height and depth to provide adequate stacking capability and which is compatible with a wide range of sheet weights.

In its broadest aspect, the invention comprises guide means for receiving a sheet at a front entrance location and for guiding the sheet along a defined path to a rear exit location; movable deflector means having a working end located at the exit location for normally deflecting the leading portion of a sheet along a path extending toward a front portion of an underlying receiving tray and for enabling the sheet to buckle rearwardly of the exit location after the leading portion of the sheet has contacted the forward portion of the tray; and sheet feed means located rearwardly of the guide means and above the tray for frictionally feeding the remaining portion of the sheet rearwardly of the tray.

The guide means preferably includes a rotatable feed roller extending transversely of the sheet feed path, and one or more endless flexible belts each above and in surface contact with the feed roller surface in the region between the entrance and exit locations to positively grip a sheet entering the device and to positively feed the sheet from the entrance location to the exit location.

The guide means also preferably include a rotatable inlet roller parallel to the rotatable feed roller but positioned forwardly of the sheet feed path for supporting a forward portion of said flexible belts so as to define an inlet throat area extending forwardly of said feed roller.

The deflector means preferably comprises a shaft extending transversely of the curved path and having one or more deflector arms secured at one end to the shaft and extending to the exit location when the deflector means is in the deflecting position.

The sheet feed means preferably includes a rear roller positioned rearwardly of the rotatable feed roller with the one or more flexible belts mounted for movement about the rear roller to provide a moving frictional surface for the underlying sheet portion assisting migration of the sheet buckle rearwardly of the device.

In accordance with a first preferred embodiment, the deflector means includes means for providing a compliant bias force releasably maintaining the working end of the deflector means at the exit location so that, as sheets accumulate in the underlying tray, the deflector can partially retract away from the exit location in response to force exerted by the initially buckling sheet. The manipulating compliant maintaining means may include a pivotable arm coupled to the deflector shaft, a link member coupled to the pivotable arm, bias means coupled to the link for providing a bias force to the arm via the link for releasably maintaining the deflector means working end at the exit location, and driving means coupled to the link for pivoting the arm via the link to rotate the shaft between a first angular position in which the deflector means working end is compliantly positioned at the exit location and a second angular position in which the deflector means working end is positively positioned in a remote position. The driving means may include a rotatable cam and a cam follower having a camming surface in engagement with the cam and an operating end coupled to the link, the cam follower being pivotally mounted to a fixed reference and the spring bias means being coupled to the operating end of the cam follower.

In accordance with a second preferred embodiment, a deflector roller is disposed rearwardly of said feed roller and in surface contact with said flexible belts for supporting said sheet as it is deflected to said forward portion, the deflector arms when in their operative position serving to guide said sheet around said deflector roller with the working end of the deflector arms extending in an arc from a first region in the vicinity of the contact between the deflector roller and the belts to a lower region adjacent the lowermost portion of said deflector roller.

The forward wall of the collecting tray preferably is oriented with respect to said exit location such that the distance to said wall will be approximately the same regardless of the height of the stacked sheets in the tray so that the forward edge of the sheet will travel a predetermined distance from the deflector exit to the wall, and so that the deflector arms may be moved to their remote position at a predetermined point in each paper ejection cycle independent of the quantity of sheets previously processed.

An override means may be provided for those applications in which the collation function is not permanently required which overrides the operation of the drive means and retains the deflector shaft in its second angular position in which the working end of the deflector arm is maintained in a non-interfering position with respect to the sheet travelling through the device.

For a fuller understanding of the nature and advantages of the invention, reference should be made to the ensuing Detailed Description taken in conjunction with the accompanying Drawing.

DESCRIPTION OF THE PREFERRED EMBODIMENTS

Figure 1:
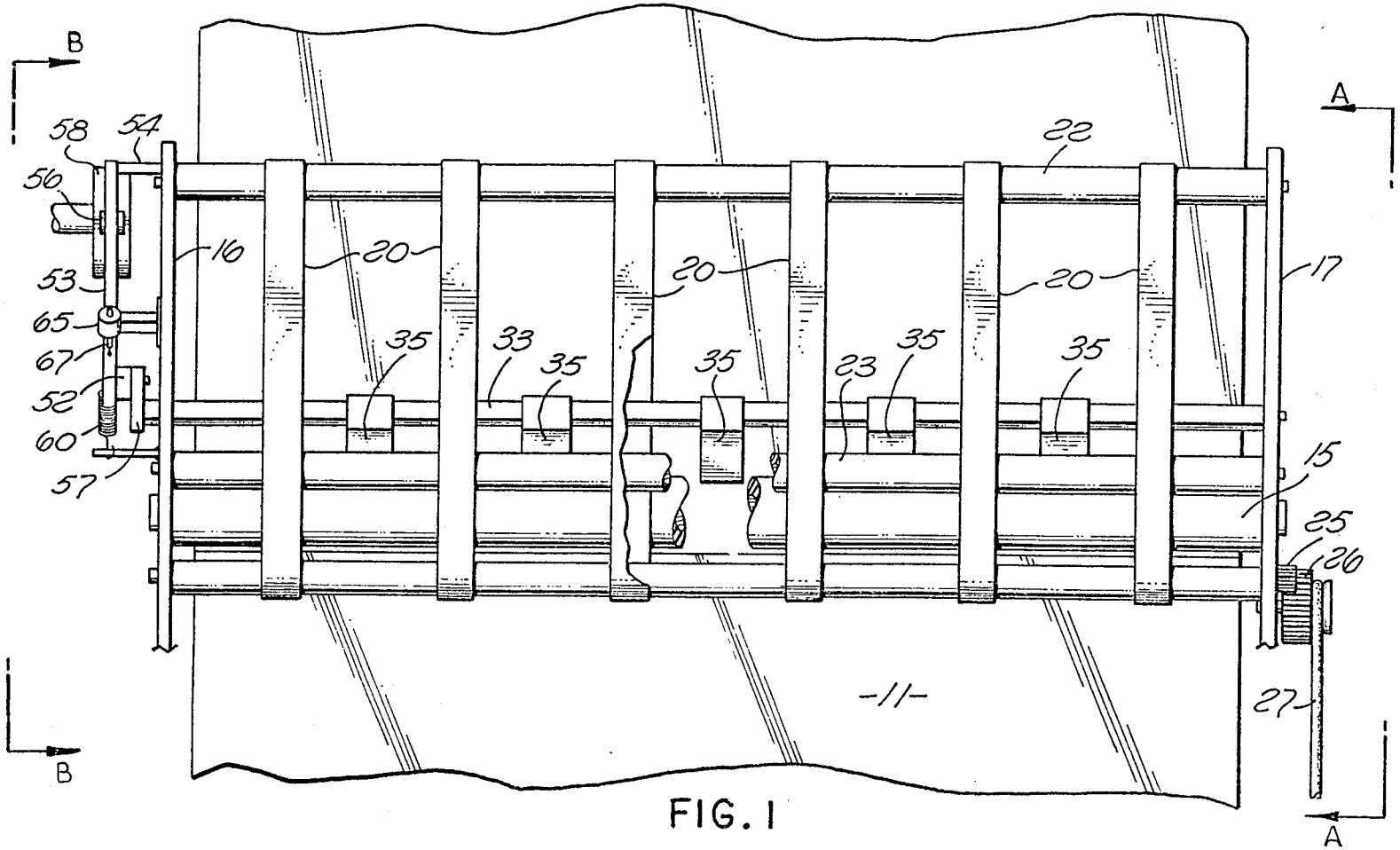
FIG. 1 is a top plan view of a first preferred embodiment of the invention.

Turning now to the drawings, FIGS. 1–6 illustrate the feed path and deflector portions of a first embodiment of the invention. As seen in these Figs., an entrance ramp 11 extending between a printing station (not shown) and an entrance location generally designated with reference numeral 12 provides a path for individual sheets to travel. The auxiliary printing station may comprise a daisy wheel printer, an electrostatic copier, or any other source of sheet documents to be stacked in a receiving tray 14, either in a collated fashion or directly. Extending transversely of the entrance 12 is a rotatable roller 15 of conventional construction which is journaled into side plates 16, 17 for free rotation about the body axis. Roller 15 is driven by a plurality of flexible endless belts 20 by frictional surface contact with the outer surface of roller 15 partially along the arcuate path connecting an upwardly angled first direction A at the entrance location 12 to a downwardly angled second direction B at an exit location 21. Each belt 20 is arranged along the path defined by a rotatable rear feed roller 22, a bias roller 23 positioned slightly behind and above roller 15, and driving forward roller 24, the latter having a spur gear 25 driven by a driving gear 26 rotated by a motor (not shown) via a timing belt 27. Motion of the belts 20 is along the direction of the arrows 30, 31 shown in FIGS. 2–6 so that the rotatable roller 15 rotates clockwise as shown in FIGS. 2–6.

Figure 2:
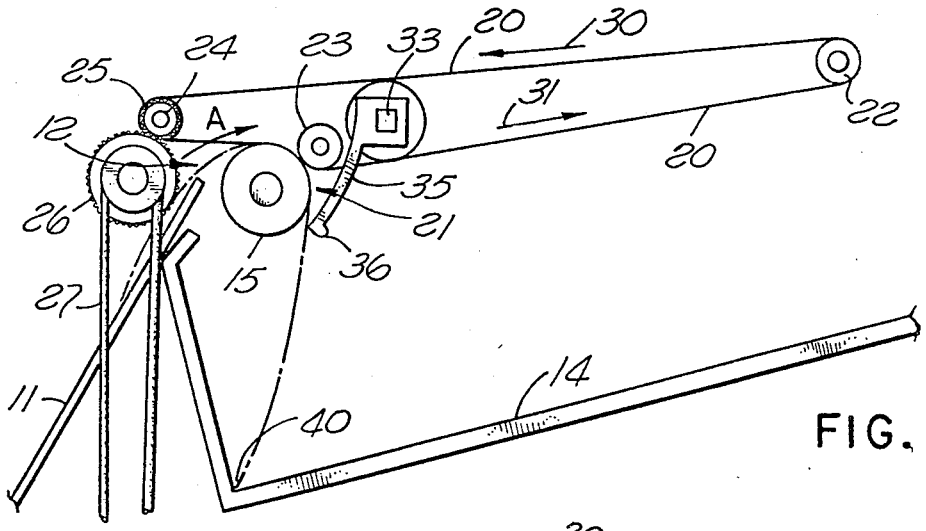
FIGS. 2–6 are schematic side views all taken generally along lines A—A of FIG. 1 sequentially illustrating the operation of the invention.
Figure 3:
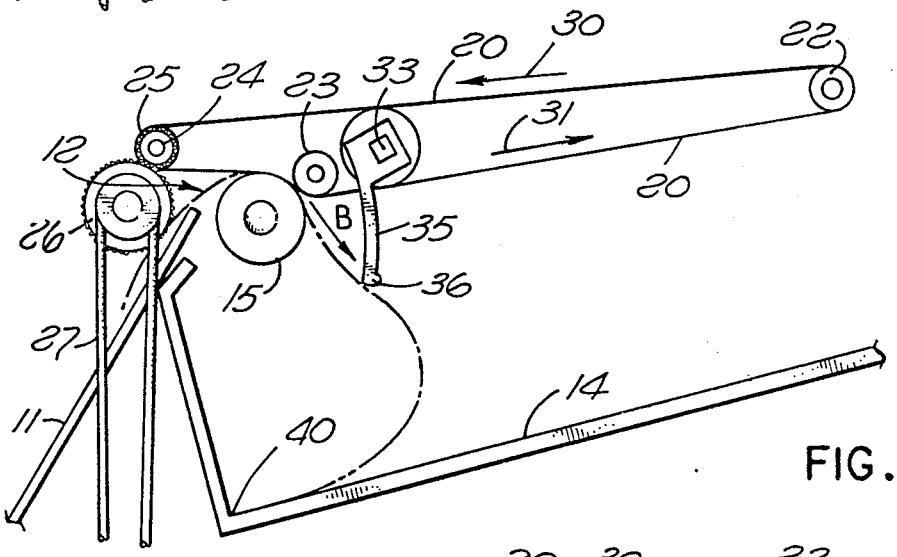

A deflector shaft 33 is carried by end plates 16, 17 and is arranged for reciprocal angular movement over a prescribed range, which is substantially 90° in the preferred embodiment. Secured along deflector shaft 33 at transversely spaced locations intermediate the belts 20 are a plurality of individual deflector arms 35 each terminating in a free working end 36 which functions to deflect the leading portion of each sheet which exits from exit location 21. As will be described more completely below, the driving mechanism for deflector shaft 33 maintains each deflector arm 35 in its active deflecting position illustrated in FIGS. 2, 3 and 6 when the leading edge reaches the exit location 21 and thereafter until the leading edge of the sheet has travelled sufficiently to abut the forward wall 40 of the receiving tray 14. Ordinarily, each deflector arm 35 will remain in the deflecting position illustrated in FIGS. 2 and 3 until the forward edge of the sheet actually engages corner 30 and the sheet begins to buckle. After the sheet buckle has fully formed, as illustrated in FIG. 3, the driving mechanism for deflector shaft 33 rotates the shaft counterclockwise (as viewed in FIGS. 2–6) to the remote position illustrated in FIG. 4 to enable the sheet to progressively buckle in the rearward direction (to the right in FIGS. 2–6) until the sheet is deposited fully into the receiving tray 14. After a certain point in the rearward migration of the sheet buckle (shown in FIG. 5), the driving mechanism for deflector shaft 33 rotates the shaft clockwise until the working end 36 of each arm 35 is repositioned in the deflecting position (FIG. 2).

Figure 4:
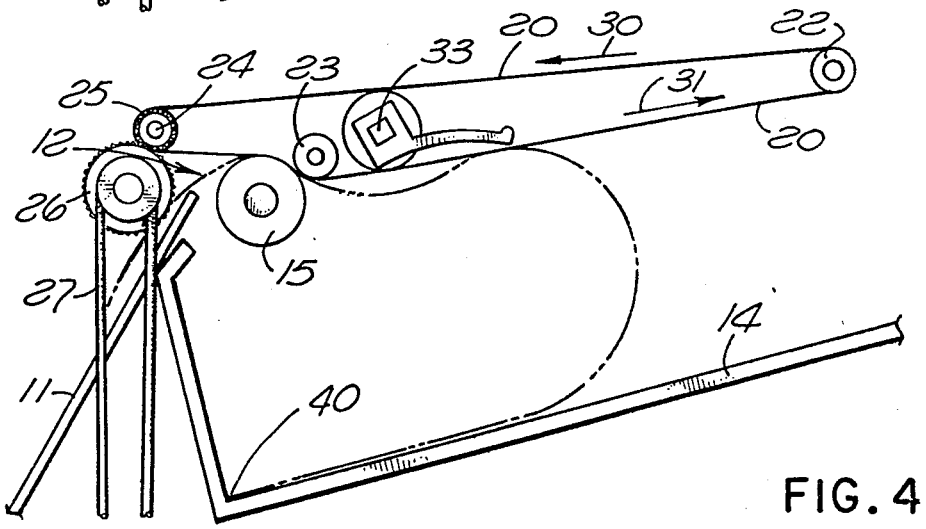
Figure 5:
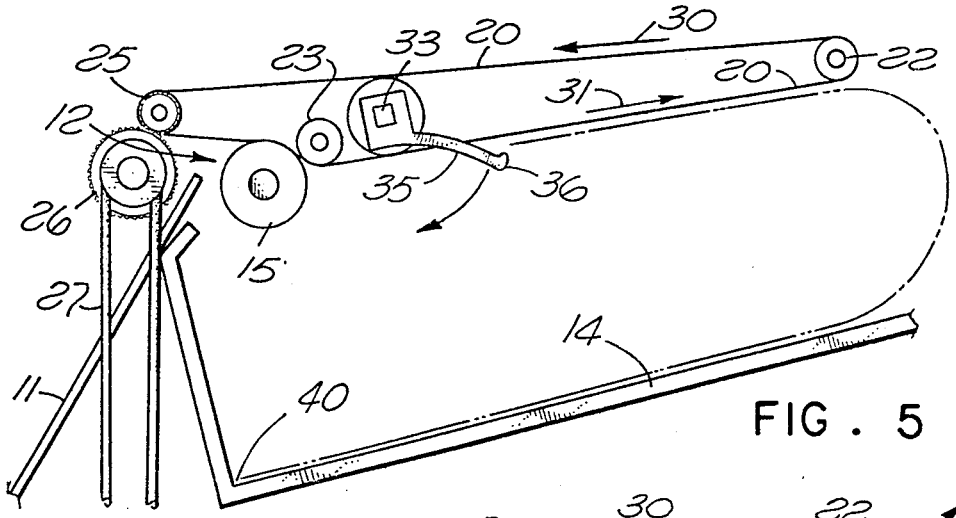
Figure 6:
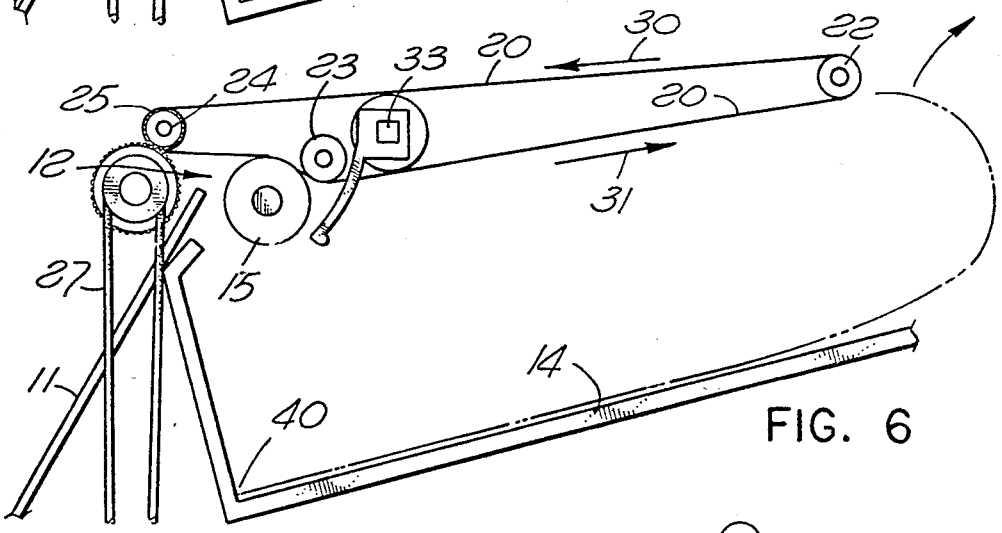

The progressive deposition of the sheet proceeds as follows: Initially, a sheet is fed along ramp 11 from the source station. As the leading edge of the sheet reaches the forwardly extending lower surface of the belts 20, it is pulled into the nip between belts 20 and roller 15, and then is drawn about the arcuate path between the entrance location 12 and the bias roller 23. As the leading edge of the sheet clears the nip just below roller 23, the immediately trailing portion continues to be positively fed along the arcuate path, and the leading edge is guided by the working ends 36 of the arms 35 toward the forward wall 40 of the underlying tray 14 (FIG. 2). After the leading edge of the sheet abuts the wall 40, the working ends 36 force the sheet to buckle, as illustrated in FIG. 3. After the buckle is fully formed, the deflector shaft 33 is rotated to remove the deflector arms 35 out of the progressive path of the sheet (FIG. 4). The trailing portion of the buckled sheet frictionally engages the underside of the rearwardly moving belts 20, and the buckle migrates rearwardly with the assistance of the belts 20. After the trailing edge of the sheet clears the working ends 36 (FIG. 5), the deflector arms 35 may be rotated back to the deflecting position while the buckle continues to migrate rearwardly until the trailing edge of the sheet clears the rear feed roller 22 (FIG. 6). The trailing portion of the sheet then releases from the belts 20 and settles into the tray 14. This operation continues with each succeeding sheet, so long as the collation function is required.

When the collation function is not to be used, the deflector shaft 33 is merely rotated to the remote position shown in FIG. 4, in which the deflector arms do not interfere with the path of a sheet through the device. In this override mode of operation, an entering sheet is drawn around the arcuate path between the entrance location 12 and the bias roller 23, but simply progresses thereafter toward the rear of the tray 14 without being inverted. This elegantly simple override function permits the device to be switched between the two modes of operation by simply operating a single mechanism (described below).

Figure 7:
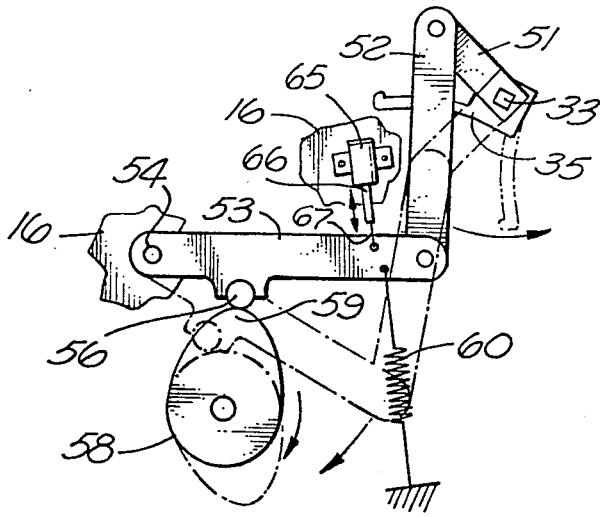
FIG. 7 is a side schematic view taken along lines B—B of FIG. 1 illustrating the deflector actuating mechanism.

FIG. 7 illustrates the operating mechanism for rotating the deflector shaft 33 between the two angular positions (i.e. active and remote) described above. As seen in this Fig., an arm 51 is connected at one end to the end of deflector shaft 33. The other end of arm 51 is pivotablly connected to an operating link 52, the other end of which is pivotally connected to one end of a cam follower 53. The other end of cam follower 53 is pivotally connected by means of a pivot post 54 to a fixed reference, e.g. end plate 16. The cam follower 53 has a follower surface 56, preferably a roller bearing, which rides on the camming surface of an eccentric cam 58, which is driven in synchronism with timing belt 27 by a suitable power takeoff mechanism (not shown). The high lobe 59 on the cam 58 provides a dwell time for the deflector shaft 33 in the remote position; the remainder of the camming surface provides dwell for the deflector shaft 33 for the deflecting position. As noted above, the amount of angular deflection afforded to the deflector arms 35 is approximately 90° in the specific embodiment shown; the angular amount will depend on the geometry of the apparatus and, in particular, the position of the deflector shaft 33 relative to the feed roller 15 and the drive belts 20. Similarly, the dwell angle for the two major portions of the cam surface may be selected to maintain the deflector arms 35 in the remote position for the requisite period of time during which the buckle migrates rearwardly of the device and the trailing edge of the sheet clears the working end 36 of each arm 36, after which each arm 35 is placed in the exit location position and maintained in this position until the buckle is fully formed in the next sheet. Alternatively, the cam may be provided with a separate motor and a suitable indexing means whereby it may be stopped in either a deflecting (with the follower 56 off the high lobe 59) or non-deflecting (remote) position (with the follower 56 resting on the high lobe).

In operation, with the deflector shaft 33 and arms 35 in their deflecting (active) position (shown in phantom line in FIG. 7), the leading edge and the leading portion of the sheet is guided by the deflector arms 35 toward the forward corner 40 of the receiving tray for a sufficient period of time to enable the leading edge of the sheet to engage the corner 40 and thereafter until the sheet buckle is fully formed. After the buckle has been fully formed, cam 58 forceably rotates follower member 53 about pivot axis 54. During this transition between the follower arm 35 deflecting position and the remote position, the link 52 is driven upwardly in FIG. 7, rotating arm 51 and consequently rotating the deflector shaft 33 and the deflector arms 35 to their remote position (as shown in solid line in FIG. 7). When the trailing edge of the buckled sheet clears the working ends 36 of the deflector arms 35, cam 58 has reached the transition point on the camming surface contour which permits the follower 53 to be forceably rotated in the clockwise direction (as seen from the direction of arrows B—B of FIG. 1) under the force of spring 60 and the arms 35 are returned to their active position.

Figure 8:
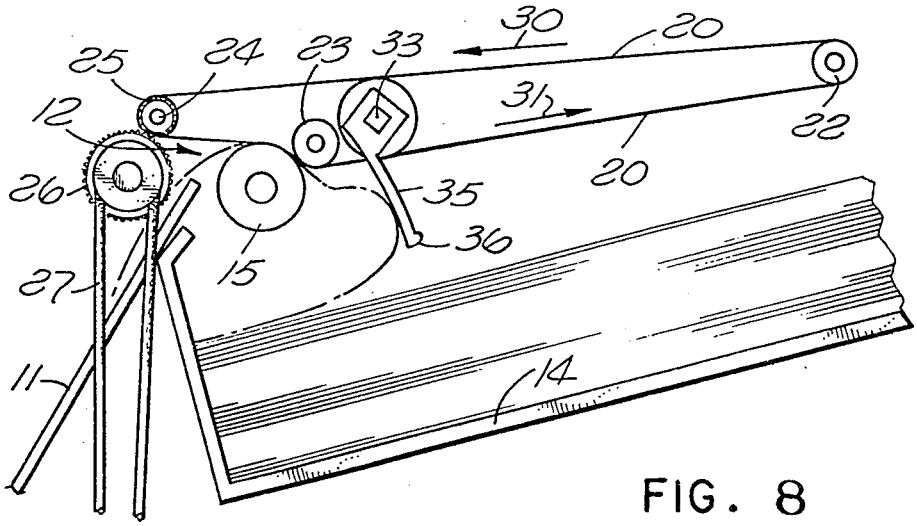
FIG. 8 is a view similar to FIGS. 2–6 illustrating the compliant operation of the deflector arms.

An important function provided by spring 60 is the compliant holding force applied to the end of cam follower 53, which is transmitted via link 52, arm 51 and shaft 33 to the deflector arms 35. In order to guarantee the proper formation of a buckle in each sheet as the stacked sheets accumulate in tray 14, the compliant spring force provided by spring 60 permits the deflector arms 35 to be partially twisted from the full deflecting position toward the remote position, when required by the compression force provided by an entering sheet. This feature is illustrated in FIG. 8: as seen in this Fig., after a substantial number of documents have accumulated in tray 14, an entering document experiences limited clearance between the top of the sheet stack and the working ends 36 of the deflector arms within which the buckle can be formed. Absent the compliant force provided by spring 60, it is highly probable that the sheet would also buckle in the forward direction (or jam), rather than form the desired single rearwardly extending buckle. However, due to the compliant spring force, the deflector arms 35 are maneuvered partially towards the remote position by the sheet itself, permitting the desired buckle to be formed.

As noted above, in some applications it is desirable to pass each sheet directly through the sheet feeding mechanism without inverting it and, according to the invention, this is simply done by maneuvering the deflector shaft 33 to the angular position in which the deflector arms 35 are positioned in the remote location shown in FIG. 4 which is a non-interfering position with the path of the sheet through the mechanism. With reference to FIG. 7, an override mechanism for providing this function includes a solenoid 65 secured to a fixed reference, such as end plate 16 and having a reciprocable plunger 66 attached to the cam follower 53 by means of a link 67. To activate the override function, it is only necessary to actuate solenoid 65 to rotate cam follower 53 to the position illustrated with deflector shaft 33 and deflector arms 35 in their remote position (shown in solid line) and maintain cam follower 53 in this position for so long as the direct feed through mode of operation is desired. To restore the collation function, the solenoid is merely deactuated. Alternatively, the cam 58 could be stopped in its non-deflecting (remote) position with follower 56 resting against high lobe 59.

Figure 9:
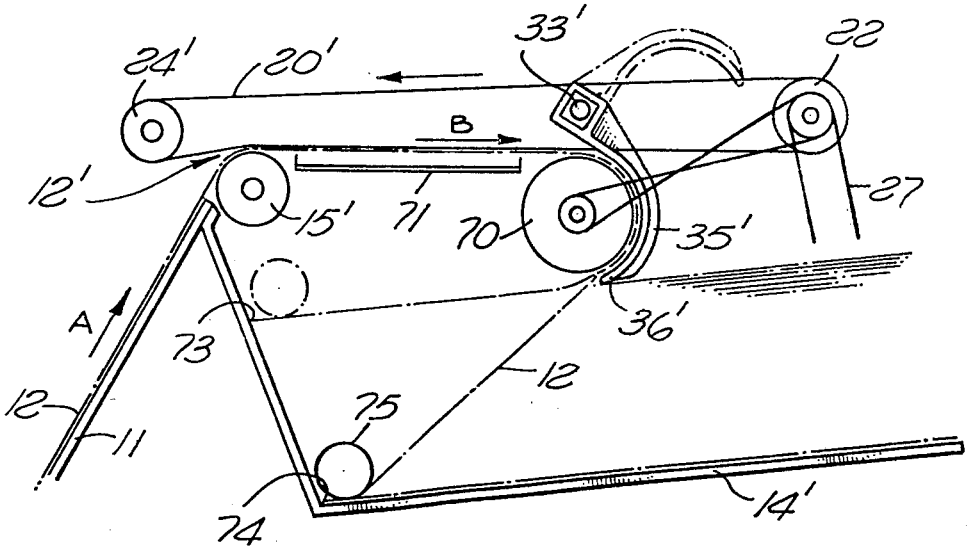
FIG. 9 is a side schematic view of a second preferred embodiment of the invention in which the deflector arms guide the sheet around a rotating deflector roller.

FIG. 9 is a schematic side view of a second preferred embodiment of the invention. By comparison with the previously described embodiment, such as shown in FIG. 8, it will be seen that this second embodiment differs primarily in that a modified form of deflector arm 35' has been employed which in its operative or deflecting position (as shown in solid line in FIG. 9) guides the leading edge of the sheet 12 around a deflecting roller 70 which is located immediately below the lower surface of the endless feed belts 20'. The deflector roller 70 is mechanically coupled to the rear feed roller 22 by means of a separate drive belt so that the surface velocity of the deflector roller 70 is approximately the same as the surface velocity of the feed belts 20'.

A guide 71 is provided intermediate the forward rotatable roller 15' and the deflecting roller 70. Forward rotatable roller 15' is in frictional contact with the feed belts 20' and together therewith serves to define a forward and a downwardly oriented throat 12' positioned above the entrance ramp 11 and which functions in a manner generally similar to that previously described with respect to the entrance location 12 of the first embodiment, guiding and drawing the forward edge of the paper (indicated symbolically by a heavy broken line) into the nip between the intake roller 15' and the drive belts 20'. Preferably, intake roller 15 is mechanically coupled to the forward idler roller 24' by means of appropriately located spur gears and/or a separate drive belt (not visible in the figure); alternatively, a pinch roller functionally similar to the aforementioned pinch roller 23 of the first embodiment could be employed to enhance the frictional drive contact between the drive belts 20' and the surface of the roller 15'.

It will be noted that front wall 40' of the sheet receiving tray 14' is oriented at a somewhat obtuse angle with respect to the bottom floor thereof. This orientation is preferably such that the distance from the lower working end 36' of the deflector arm 35' to the front wall 40' is approximately equal regardless of the height of the stack of sheets in the tray 14'. In particular, it will be seen that the distance from end portion 36' to the point 73 where the top sheet of the fully loaded receiving tray 14 contacts the front wall 40' is approximately equal to the distance between the aforementioned working end 36' and the lowermost point 74 of the front wall 40'.

By moving the deflector shaft 33' and the arms 35' somewhat rearwardly compared to that of the first embodiment and by orienting the front wall 40' obtusely as has just been described, it will be appreciated that regardles of the height of the stack of sheets then in the receiving tray 14', the point in the timing cycle at which the leading edge of the sheet first contacts the wall 40' and the desired rearwardly oriented buckle has been initiated by the curved shape of the sheet as it is guided around the rear half of the deflector roller 70 by the modified deflector arms 35' will be essentially invariant, as will also be the corresponding required movement of the deflector arms 35' from their deflecting position (shown in solid line in the figure) to their raised non-deflecting position (shown in phantom line). Accordingly, the compliant spring arrangement of the first embodiment may be dispensed with and a simple two-position mechanism may be used in its place. In order to avoid the necessity for precise synchronization between the timing and speed of the upward movement of the modified deflector arms 35' with the forward movement of the sheet 12, a snubbing device 75 is preferably provided at the forward end of the paper tray 14 which effectively holds the forward edge of the top sheet against the front wall 40' as the deflector arm is withdrawn to its remote position; otherwise, particularly when only a few sheets of paper are in the tray 14', once the paper is no longer restrained by the deflecting arm 35 to follow the relatively sharp curvature of the deflector roller 70, the unrestrained buckle could tend to spring the forward edge of the sheet rearwardly and the sheet would be laid down in an uninverted position, the same as though the deflector arms 35' had remained in their raised position for the entirety of the sheet ejection cycle.

As will now be apparent, sheet feeding mechanisms fabricated in accordance with the teachings of the invention afford a relatively simple and reliable document inversion function or a direct feed through function, depending on the requirements of a particular application. In addition, the particular configuration of the active elements of the invention enable the sheet feed mechanism to be constructed with a relatively low height profile and a relatively shallow depth profile. Specifically, as best seen in FIG. 6, both the height and the depth of the sheet feed mechanism may be substantially less than the length of the longest sheet to be processed through the mechanism. Further, by employing a plurality of transversely spaced belts 20 at the entrance location 12, a roller 15 of substantially reduced diameter from the typical platen type roller normally employed at the entrance feed location can be used without affecting the ability of the device to positively introduce entering documents into the arcuate feed path without suffering skewing of the sheet, wrinkling or jamming. Consequently, the height profile of the sheet feed mechanism is reduced even further by the invention. The compliant holding force applied to the deflector arms by means of spring 60 (or the tilted front wall of the alternate embodiment) enables the collation function to proceed reliably over the entire stacking range of the tray 14. In addition, the collation function may be overriden at any time by simply operating the solenoid 65, or appropriate manipulation of the cam 58, even to the extent that alternate documents may be subjected to alternate direct and reverse feeding.

While the above provides a full and complete disclosure of two preferred embodiments of the invention, various modifications, alternate constructions and equivalents may be employed without departing from the true spirit and scope of the invention. Therefore, the above description and illustrations should not be construed as limiting the scope of the invention, which is defined by the appended claims.

What is claimed is:

1. A sheet handling apparatus for enabling sheets of paper fed from a printing station to be stacked in a receiving tray, said sheet handling apparatus comprising:

means for positively feeding a sheet entering said apparatus at an entrance location from a first direction to an exit location from which said sheet may exit in a second rearwardly facing direction;

a deflector roller in the vicinity of said exit location;

a pivoting deflector arm having a concave working end normally to the rear of and extending circumferentially about said deflector roller and downwardly to a third location at a portion of said concave working end remote from an upper portion of said concave working end at said exit location for normally deflecting the leading portion of said sheet around a portion of said deflector roller and then forwardly along a third direction towards a front wall of said receiving tray and for forming a buckle in said sheet rearwardly of said feeding means whereby the buckled portion of said sheet may commence to move rearwardly after the leading portion of said sheet has contacted said front portion of said tray;

means for manipulating said working end of said deflector means from said exit location to a remote position once said sheet has commenced to buckle rearwardly away from said deflector roller; and a plurality of sheet feeding belts extending rearwardly of said feeding means and said deflector roller and above said third location said belts having a downwardly facing frictional surface for frictionally feeding the remaining portion of said sheet of paper rearwardly of said deflector roller;

wherein said remote location of said deflector arm is above said feeding belts, and said manipulating means includes means for moving said working end of said deflector arm from its normal operative position about said deflector roller through a gap between adjacent ones of said sheet feeding belts to an inoperative position above said sheet feeding belts, said manipulating means further including means for returning said working end of said deflector arm from said inoperative position to said normal position after the rear edge of said sheet has cleared said working end of said deflector arm.

2. The apparatus of claim 1 wherein said feeding means includes a movable endless flexible belt disposed about said circumferential segment of said deflector roller from a position adjacent said entrance location to a position adjacent said exit location, and means for translating said flexible belt from said entrance location to said exit location.

3. The apparatus of claim 1 wherein said sheet feed means includes a feed roller positioned rearwardly of said deflector roller, said plurality of flexible belts being mounted for movement about said feed roller to provide a plurality of transversely spaced moving frictional surfaces for the underlying sheet.

4. The apparatus of claim 1 wherein said manipulating means includes a link coupled to said pivotable deflector arm, bias means coupled to said link for providing a bias force to said arm via said link for releasably maintaining said deflector arm working end at said exit location, and driving means coupled to said link for pivoting said arm via said link to rotate said shaft between a fixed angular position in which said deflector arm working end is positioned at said exit location and a second angular position in which said deflector means working end is positioned at said remote position.

5. The apparatus of claim 4, wherein said driving means comprises a rotatable cam, and a cam follower having a camming surface in engagement with said cam and an operating end coupled to said link, said cam follower being pivotally mounted to a fixed reference and said bias means being coupled to said operating end of said cam follower.

6. The apparatus of claim 1 further comprising a rotatable shaft and a plurality of individual ones of said deflector arms each secured at one end to a different transverse location of said shaft and each extending to a different transverse position at said exit location when said deflector means is in the deflecting its said normal position, each of said arms terminating in a working end.

7. The apparatus of claim 1 wherein said manipulating means comprises;

a driven member coupled to said deflector arm and arranged for movement between first and second positions corresponding to the normal position and the remote position of said deflector arm working end, respectively;

means for normally biasing said driven member to said first position; and driving means for overriding said biasing means and maneuvering said driven member to said second position.

8. The apparatus of claim 1 wherein said manipulating means includes means for providing a compliant bias force releasably maintaining said working end of said deflector arm at said exit location.

9. The apparatus of claim 1 further including means for overriding the operation of said manipulating means to maintain said working end of said deflector arm in said remote position.

10. The apparatus of claim 1 wherein said front wall of said receiving tray is positioned obtusely with respect to said deflector roller and said deflector arm and a bottom surface of said tray such that when said deflector arm is in its said normal position extending circumferentially about said deflector roller, the distance from said third location to the point where the uppermost sheet of a stack of said sheets in said tray contacts said front wall is approximately equal to the distance from said third location to the lowermost point of said front wall.

* * * * *